US006024249A

United States Patent [19]

On

[11] Patent Number: 6,024,249

[45] Date of Patent: Feb. 15, 2000

[54] FLUID DELIVERY SYSTEM USING AN OPTICAL SENSOR TO MONITOR FOR GAS BUBBLES

[75] Inventor: Ching Tu On, Hsin Chu, Taiwan

[73] Assignee: Taiwan Semiconductor Manufacturing Company, Hsin-Chu, Taiwan

[21] Appl. No.: 08/883,649

[22] Filed: Jun. 27, 1997

[51] Int. Cl.[7] ..... B05C 5/00

[52] U.S. Cl. ..... 222/52; 222/1; 118/52; 118/319; 118/320

[58] Field of Search ..... 222/52, 1, 61; 118/52, 319, 320, 688

[56] References Cited

U.S. PATENT DOCUMENTS

| | | | |
|---|---|---|---|
| 4,646,796 | 3/1987 | Krause | 141/234 |
| 4,700,870 | 10/1987 | Schleicher et al. | 222/63 |
| 4,857,750 | 8/1989 | Millis et al. | 250/573 |
| 4,881,487 | 11/1989 | Moore | 116/227 |
| 5,054,650 | 10/1991 | Price | 222/1 |
| 5,493,922 | 2/1996 | Ramey et al. | 73/863.02 |
| 5,565,034 | 10/1996 | Nanbu et al. | 118/668 |

FOREIGN PATENT DOCUMENTS 163069 12/1985 European Pat. Off. ..... G01P 13/00

*Primary Examiner*—J. Casimer Jacyna
*Attorney, Agent, or Firm*—George O. Saile; Stephen B. Ackerman; William J. Stoffel

[57] ABSTRACT

The present invention provides a fluid delivery system for delivering fluid for a semiconductor manufacturing operation using a sensor to monitor fluid flow and stop fluid flow when gas bubbles or uneven fluid flow occurs. The system comprises: a fluid container 10 connected to a pressurized gas supply 18 by a gas supply tube 17; the fluid container 10 connected to a fluid feed tube 16; the fluid container 10 partially filled with a fluid 12; the fluid feed tube 16 having an inlet end 16A and an outlet end 40; a stop valve 20 connected in the fluid feed tube 16 between the fluid container 10 and the outlet end 40; an optical sensor 30 connected to the fluid feed tube 16; a control computer 39 for actuating the stop valve based on the analysis of the fluid by the optical sensor. The fluid flows from the fluid container 10 onto the wafer 50. The optical sensor 30 monitors the flow of the fluid and stops the flow of fluid when the fluid flowing past the optical sensor 30 contains gas bubbles or flows unevenly.

16 Claims, 2 Drawing Sheets

FIG. 1 – Prior Art

FLUID DELIVERY SYSTEM USING AN OPTICAL SENSOR TO MONITOR FOR GAS BUBBLES

BACKGROUND OF INVENTION

1) Field of the Invention

This invention relates generally to a fluid dispensing system/tool, more particularly to fluid dispensing systems for semiconductor manufacturing equipment and particularly to a fluid supply system for dispensing fluid onto semiconductor wafers and more particularly to a sensor monitor for monitoring bubbles and uneven fluid flow in photoresist, etchant or spin-on-glass fluid in a semiconductor manufacturing tool/fluid dispensing system.

2) Description of the Prior Art

Three of the most important operations in semiconductor manufacturing are spin-on-glass coating, photoresist coating and etching steps. First, Spin-on-glass is used as a planarization layer to planarize the uneven surface of a wafer. A spin-on-glass fluid is evenly dripped or sprayed onto a spinning wafer. The spin-on-glass fluid must be applied evenly onto the wafer so that the layer evenly fills the valleys in the surface. The fluid must flow evenly and not contain any bubbles. Bubbles in the spin-on-glass fluid can create defects in the spin-on-glass layer. For example, a bubble in an SOG layer can be etched through in a subsequent etch back step. The etch can expose underlying metal layers and other structures. This can lead to shorts with overlying conductive layers or to disruption of overlying layer structures from falling into "Bubble holes".

Second, resist patterning techniques employed in the semiconductor lithographic process fundamental to integrated circuit manufacturing usually rely on a fluid dissolution step to remove photoresist polymer either made more soluble or left less resistant to dissolution by selective exposure to some type of photon irradiation or particle bombardment. The photoresist is etched to form a photoresist pattern. It is critically important to control this photoresist pattern. Uneven resist flow can lead to uneven photoresist layers and incomplete patterns. Moreover, bubbles in photoresist fluid can also cause photo pattern defects. These defects will cause wafers to be scrapped.

A third important process is the etch step. Etch chemicals (e.g., BOE, buffered HF) must be applied to the wafer to etch the photoresist and the exposed semiconductor layers (e.g., oxide). It is important for the etch chemical to be applied without any bubbles so that the layers are etched evenly.

In these three operations, (i.e., photoresist coating, SOG coating, and etching), a fluid must be applied to a semiconductor wafer in a very controlled even manner so that the photoresist, spin-on-glass and etched layers do not contain any defects. Presently, as shown in FIG. 1, a fluid level sensor 110 is used to ensure that the fluid 120 level in a fluid supply tank 100 is maintained at the proper level. The sensor 110 is connected to an amplifier 120 and to an alarm 130. When the fluid level gets too low the alarm sounds. This system stops the process before a lot of wafers are ruined because of low fluid levels in the tank. However, even with this system some wafers get ruined before the alarm sounds. Alternatively, a lot of good fluid is thrown out if the alarm sounds too soon when sufficient fluid remains in the tank.

However, other problems, such as bubbles and uneven flow, impact fluid flow and cause defects in semiconductor devices on the wafers. These problems are not always related to low fluid levels and are not solved by the tank level sensor of the prior art.

We have found that a major problem in applying fluids to semiconductor wafers is gas bubbles in the fluids. These gas bubbles create defects in the layers over the wafer thus reducing yields. Presently, the gas bubble problem is found only after the wafers are tested and defects found on the wafers. By this time many wafers have been processed and many wafers have the defects.

The importance of overcoming the various deficiencies noted above is evidenced by the extensive technological development directed to the subject, as documented by the relevant patent and technical literature. The closest and apparently more relevant technical developments in the patent literature can be gleaned by considering U.S. Pat. No. 4,881,487(Moore) which shows a fluid level sensing method and apparatus used in a photoresist tool. A bubble is introduced into the fluid and the bubble is used to detect the photoresist level. U.S. Pat. No. 4,646,796(Krause) shows an apparatus for detecting the level of a liquid in a container filling machine using an infrared photo detector. U.S. Pat. No. 5,493,922(Ramey et al.) shows a liquid level sensing probe and control circuit. U.S. Pat. No. 4,857,750(Millis et al.) shows a sensor for determining the photoresist developer strength.

Yet, there is still a need to develop a method and device for preventing bubbles in SOG flow and chemical fluid flow and for forming a more uniform SOG or photoresist coating on a wafer.

SUMMARY OF THE INVENTION

It is an object of the present invention to provide a fluid delivery system that detects the presence of gas bubbles and uneven fluid flow in a fluid passing by an optical sensor.

It is an object of the present invention to provide a fluid delivery system that detects the presence of gas bubbles/uneven flow in an etchant or spin-on-glass fluid passing by an optical sensor in a semiconductor wafer coating tool/operation.

It is an object of the present invention to provide a fluid delivery system and method that detects the presence of gas bubbles in a spin-on-glass fluid, etchant fluid or other chemical fluid passing by an optical sensor in a semiconductor wafer coating operation and stops the fluid flow when bubbles or uneven flow are detected.

To accomplish the above objectives, the present invention provides a method and a fluid delivery system for delivering fluid for a semiconductor manufacturing operation from a fluid container to a semiconductor wafer using a sensor to monitor the fluid flow and stop the fluid flow (or set off an alarm) when gas bubbles or uneven fluid flow occur, comprising:

- a fluid container 10 connected to a pressurized gas supply 18 by a gas supply tube 17; and the fluid container 10 connected to a fluid feed tube 16; the fluid container 10 partially filled with a fluid 12; the fluid preferably comprised of a photoresist, water, chemical liquid or a spin-on-glass material;
- the fluid feed tube 16 having an inlet end 16A in the fluid 12 in the fluid container 10 and an outlet end 40 above a semiconductor wafer 50; the outlet end 40 having a nozzle for dispensing the fluid on a wafer;
- a stop valve 20 connected in the fluid feed tube 16 between the fluid container 10 and the outlet end 40;
- a suck back valve 24 connected to the fluid feed tube 16 between the stop valve 20 and the outlet end 40;
- the fluid feed tube having a transparent section 16B; an optical sensor 30 connected to the fluid feed tube 16 between the suck back valve 20 and the outlet end 40; the optical sensor 30 is position a distance from the outlet end between about 4 and 24 inches; the optical sensor overlying the transparent section of the feed tube;

a control computer 39 for actuating the stop 20 and suck back valves 24 based on the analysis of the fluid 10 by the optical sensor 30;

whereby the fluid flows from the fluid container 10 onto the wafer 50 and the optical sensor 30 monitors the flow of the fluid and stops the flow of fluid when the fluid flowing past the optical sensor 30 contains gas bubbles or flows unevenly.

The fluid delivery system of the current invention provides an optical sensor 30 which monitors the fluid flow in a wafer coating/spraying operation. The system sets off an alarm or stops the process whenever the fluid contains bubbles or flows unevenly. The optical sensor allows the fluid to be shut and the fluid delivery system fixed to eliminate the bubble flow problem. The optical sensor eliminates wafer rework by detecting the problem before many wafers are coated with defective fluid. The optical sensor improves wafer yields by improving photoresist and spin-on-glass quality. The optical sensor improves production by quickly identifying problems and reducing wafer rework. When the tube or piping leak and bubbles form in the tube, the system automatically shuts off the fluid flow and alarms to prevent the bubbles from causing poor coatings on the wafers and mass wafer scrap.

BRIEF DESCRIPTION OF THE DRAWINGS

The features and advantages of a fluid delivery system and fluid dispensing tool according to the present invention and further details of a process for delivering the fluid using the system/tool in accordance with the present invention will be more clearly understood from the following description taken in conjunction with the accompanying drawings in which like reference numerals designate similar or corresponding elements, regions and portions and in which.

DETAILED DESCRIPTION OF THE PREFERRED EMBODIMENTS

The present invention will be described in detail with reference to the accompanying drawings. The present invention provides a fluid delivery system for delivering fluid for a semiconductor manufacturing operation from a fluid container to a semiconductor wafer using a sensor to monitor fluid flow.

The fluid delivery system of the present invention can be used on any fluid delivery tool and any fluid, such as spin-on-glass, water, and etchants. The invention is preferable used with the tools shown in table 1:

TABLE 1

| | Manufacturer and mfg. address | model number | process step |
|---|---|---|---|
| SOG tool | Tokyo Ohka Kogyo Co. LTD 150 Maka-maruko, Nakahara | OCD, T-2, P-481316-SG | planarization |
| Clean & Wet clean station & BOE | Kawasaki-shi, Kanagawa, Japan 21 Zmerak | | clean & wet etching & BOE oxide dipping |

Figure 2:
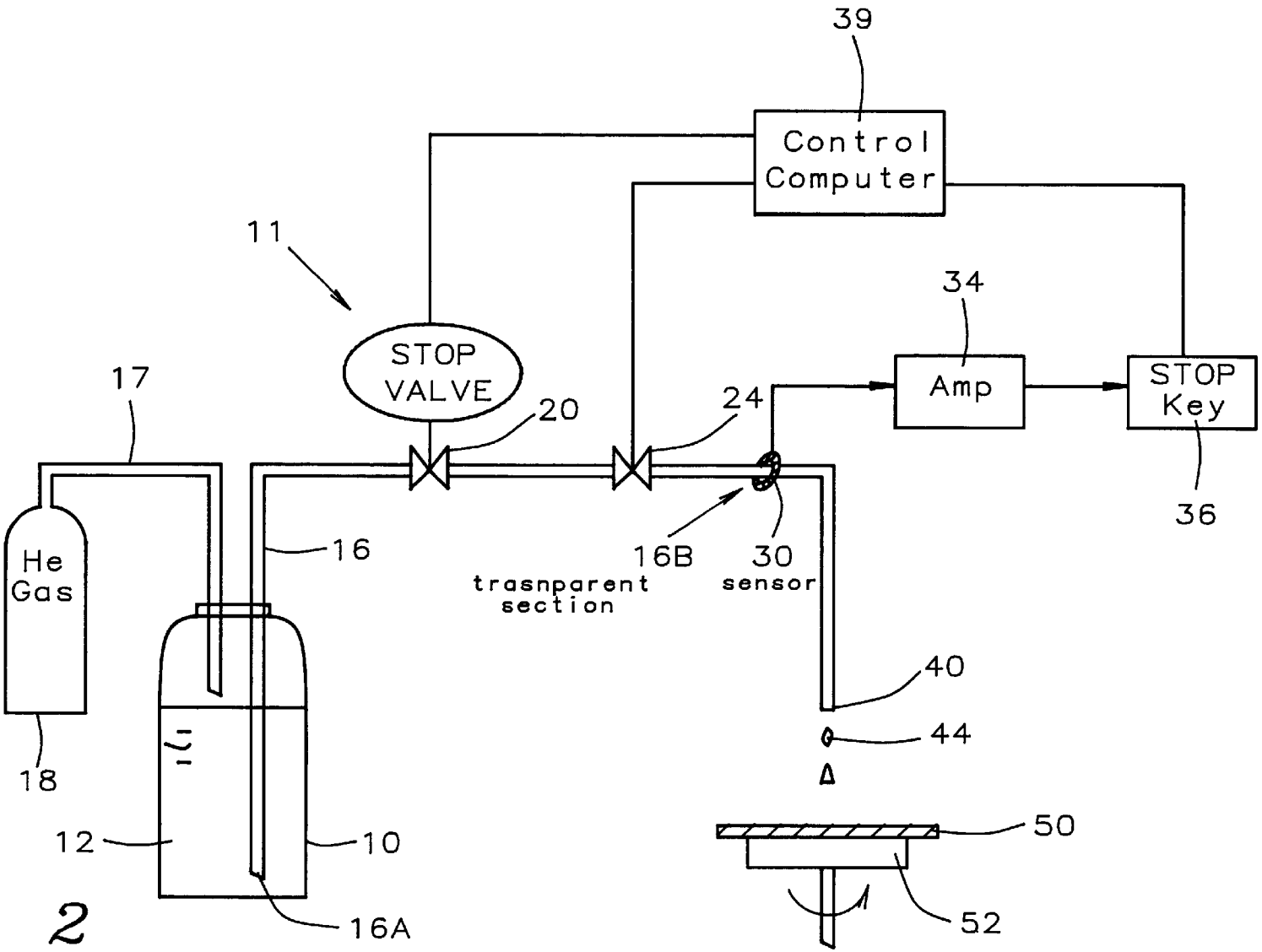
FIG. 2 is a schematic view for illustrating the fluid delivery system having an optical fluid sensor in a fluid dispensing tool in semiconductor manufacturing in accordance with the present invention.

Referring to FIG. 2, the fluid delivery system 11 of the invention comprises a fluid container 10 connected to a pressurized gas supply 18 by a gas supply tube 17. The fluid container 10 is connected to a fluid feed tube 16. The fluid delivery system can comprise a fluid delivery system for semiconductor manufacturing and is preferably a etch, clean or a spin-on-glass dispensing tool/system. However, the fluid delivery system of the invention having an optical sensor can be implemented on any process to deliver any fluid where bubble free and even flowing fluid is required.

The fluid container 10 is preferably partially filled with a fluid 12. The fluid 12 is preferably comprised of a water, chemical liquid, etchant or spin-on-glass. However, the fluid system and optical sensor/bubble detector system of the invention can be used on any fluid that in which gas bubbles can be detected within by an optical sensor. The invention is not limited to the preferred semiconductor related chemicals or the chemicals listed herein.

The fluid feed tube 16 has an inlet end 16A in the fluid 12 in the fluid container 10 and an outlet end 44 above a semiconductor wafer 50. The outlet end preferably comprises a nozzle for dispensing fluid on a wafer 50. The wafer is preferably seated on a rotating wafer chuck 52 in a wafer coating/spraying/cleaning tool (not shown).

A stop valve 20 is preferably connected in the fluid feed tube 16 between the fluid container 10 and the outlet end 40. The stop valve 20 is used to stop the fluid flow when the correct amount of fluid is dispensed or when the optical sensor of the invention detects gas bubbles or uneven flow in the fluid. The stop valve can be connected to computer monitoring and valve actuating equipment 34 36.

The amplifier 34 amplifies the signal from the optical sensor 30.

A suck back valve 24 is preferably connected to the fluid feed tube 16 between the stop valve 20 and the outlet end 40. The suck back valve when activated, pulls the fluid in the fluid feed tube back a distance from the outlet end about between 1 and 5 mm.

The suck back valve is preferably connected to a Venturi where air flowing past an inlet in the tube 16 creates a low pressure which draws the fluid in the tube back. The suck valve is preferably connected to control computer 39 (e.g., control computer of the dispensing machine). The machine tells the suck valve when to apply a suction.

An optical sensor 30 is preferably connected to the fluid feed tube 16 between the suck back valve 20 and the outlet end 40.

The optical sensor 30 functions by detecting a different intensity of light passed through fluid containing bubbles compared to bubble-less fluid.

The optical sensor can be optical sensor made by: Keyance company; model FS-2, address: 1-3-14 Higashinakajima Higashiyodogama-ku, Osaka 533, Japan. This optical sensor is the preferably an optical sensor calibrated for spin-on-glass, etchant or photoresist fluid that is being monitored.

The optical sensor 30 is preferably positioned (in the feed tube 16) a distance from the outlet end between about 4 and 24 inches. The fluid feed tube 16 preferably has a transparent section 16*b*. The optical sensor preferably overlies the transparent section 16B of the feed tube. The transparent section preferably has a width between about 2.0 and 5.0 mm. The transparent section is preferably extends around the entire tube.

The optical sensor monitors the flow of the fluid between the fluid container and the outlet end. The optical sensor detects bubbles which change the amount light going through the fluid.

The sensor 30 is preferably connected to a controller 39 and set off an alarm. Also, the sensor/controller can directly shut off the fluid flow. The controller 34 36 39 preferably stops the flow of fluid when the fluid flow past the optical sensor when the fluid contains gas bubbles or the fluid flows unevenly.

The optical sensor monitors the optical transparency of the fluid, and signals out of the sensor are transmitted to the control computer 39 by a line. The control computer 39 compares the optical transparency of the fluid with a known or measured value. The computer 34 36 sets off an alarm or stops the process if bubbles or uneven flow is detected. In other embodiments of the invention, the sensor 30 can just set off an alarm and corrective actions be take by line workers. In other situations, a control computer can shut down the processes or stop the fluid flow.

The applicant has found that the bubble problem in the fluids can be caused by low fluid tank levels and by gas leaks in the fluid supply line. However, the system of the invention can prevent wafer loss by immediately stopping the process.

Without the invention's optical sensor and control system, the applicant only found the bubble problem after many wafers were scrapped. The bubble problem was fixed by leak checking the lines and/or replacing the fluid tank.

When the optical sensor 30 detects bubbles in the fluid an alarm rings and the machine will stop the fluid dispensing process. The machine stop key sends a signal to close the stop valve and stop the fluid flow.

A control computer 34 39 can be used for actuating the stop and suck back valves based on the analysis of the fluid by the optical sensor.

Figure 1:
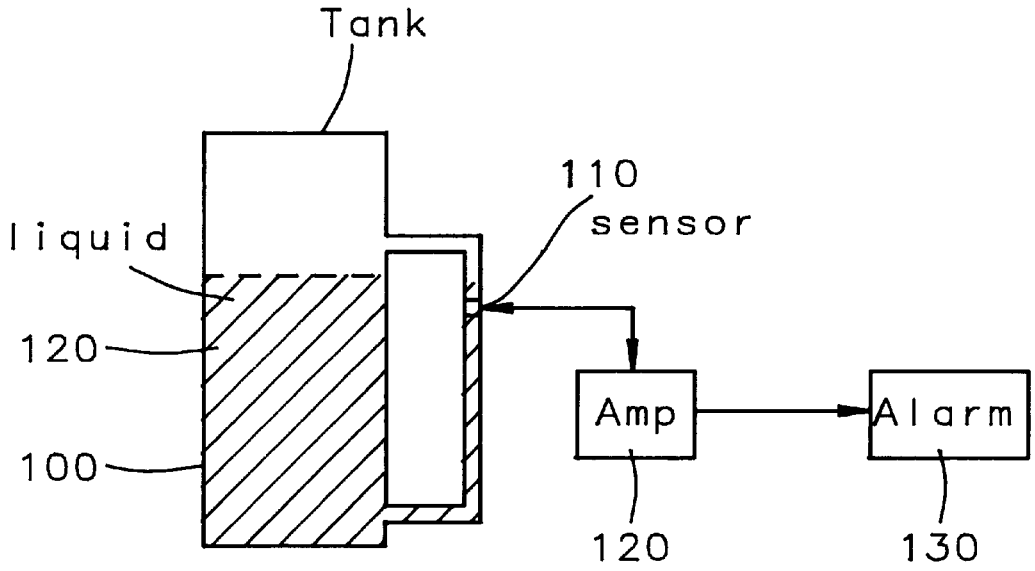
FIG. 1 is a fluid level sensor located in the fluid container according to the prior art.

An optional fluid tank level sensor 110 can be implemented on the fluid tank as shown in FIG. 1. The fluid level sensor monitors the level of the fluid in the fluid tank. The fluid level indicator is connected to an alarm.

The fluid delivery system and method of the current invention provides an optical sensor which monitors the photoresist and spin-on-glass flow and sets off alarms whenever the fluid contains bubbles or flows unevenly. The optical sensor immediately detects the bubble problems and stops the process. The fluid delivery system can then be fixed to eliminate the bubble flow problem. The optical sensor eliminates wafer rework by detecting the problem before many wafers are coated with defective fluid. The optical sensor improves wafer yields by improving pr and spin-on-glass quality. The optical sensor improves production by quickly identifying problems and reducing wafer rework.

While the invention has been particularly shown and described with reference to the preferred embodiments thereof, it will be understood by those skilled in the art that various changes in form and details may be made without departing from the spirit and scope of the invention.

What is claimed is:

1. A fluid delivery system for a semiconductor manufacturing operation for delivering fluid from a fluid container to a semiconductor wafer using an optical sensor to monitor the flow of fluid and presence of gas bubbles comprising:

a fluid container connected to a fluid feed tube; said fluid container partially filled with a fluid;

said fluid feed tube having an inlet end in said fluid in said fluid container and an outlet end above a semiconductor wafer; said outlet end comprising a nozzle;

a suck back valve connected to said fluid feed tube between said fluid container and said outlet end;

an optical sensor connected to said fluid feed tube between said suck back valve and said outlet end; said optical sensor not located in said nozzle;

whereby said optical sensor monitors the flow of said fluid between said fluid container and said outlet end and stopping the flow of fluid when the fluid flowing past said optical sensor contains gas bubbles or flows unevenly.

2. The fluid delivery system of claim 1 which further includes a stop valve; said stop valve connected to said fluid feed tube between said suck back valve and said fluid container; said suck back valve when activated, pulls said fluid in said fluid feed tube back a distance from said outlet end about between 1 and 5 mm.

3. The fluid delivery system of claim 1 wherein said fluid is comprised of a material selected from the group consisting of photoresist, etchants, water, and spin-on-glass.

4. The fluid delivery system of claim 1 wherein said fluid is comprised of spin-on-glass.

5. The fluid delivery system of claim 1 wherein said optical sensor is positioned a distance from said outlet end between about 4 and 24 inches.

6. The fluid delivery system of claim 1 wherein said fluid feed tube comprises a transparent section; said optical sensor overlying said transparent section of said feed tube.

7. The fluid delivery system of claim 1 wherein said outlet end comprises a nozzle for dispensing fluid on a wafer.

8. The fluid delivery system of claim 1 which further includes a stop valve connected to said fluid feed tube between said fluid container and said suck back valve; a control computer for actuating said stop valve based on the analysis of said fluid by said optical sensor.

9. The fluid delivery system of claim 1 which further includes a fluid level sensor on said fluid container, said fluid level sensor monitoring the level of said fluid in said fluid container, said fluid level indicator connected to an alarm.

10. A fluid delivery system for delivering fluid for a semiconductor manufacturing operation from a fluid container to a semiconductor wafer using an optical sensor to monitor fluid flow comprising:

a fluid container containing a fluid; said fluid container connected to a pressurized gas supply by a gas supply tube and said fluid container connected to a fluid feed tube; said fluid is comprised of a material selected from the group consisting of water, etchants and spin-on-glass;

said fluid feed tube having an inlet end in said fluid in said fluid container and an outlet end above a semiconductor wafer; said outlet end having a nozzle for dispensing fluid on a wafer;

a stop valve connected in said fluid feed tube between said fluid container and said outlet end;

a suck back valve connected to said fluid feed tube between said stop valve and said outlet end; said suck back valve when activated, pulls said fluid in said fluid feed tube back a distance from said outlet end about between 1 and 5 mm;

an optical sensor connected to said fluid feed tube between said suck back valve and said outlet end; said optical sensor is position a distance from said outlet end between about 4 and 24 inches; said fluid feed tube having a transparent section; said optical sensor overlying said transparent section of said feed tube; said optical sensor not located in said nozzle;

a control computer for actuating said stop and suck back valves based on the analysis of said fluid by said optical sensor;

whereby said optical sensor monitors the flow of said fluid between said fluid container and said outlet end; and stopping the flow of fluid when the fluid flowing past said optical sensor contains gas bubbles or flows unevenly.

11. The fluid delivery system of claim 10 which further includes a fluid level sensor on said fluid container, said fluid level sensor monitoring the level of said fluid in said fluid container, said fluid level indicator connected to an alarm.

12. A method of dispensing fluid onto a semiconductor wafer using a dispensing unit which comprises:

a fluid container connected to a fluid feed tube; said fluid container partially filled with a fluid;

said fluid feed tube having an inlet end in said fluid in said fluid container and an outlet end above a semiconductor wafer; said outlet end comprising a nozzle;

a stop valve connected to said fluid feed tube between said fluid container and said outlet end;

a suck back valve connected to said fluid feed tube between said stop valve and said outlet end;

an optical sensor connected to said fluid feed tube between said suck back valve and said outlet end; said optical sensor not located in said nozzle;

a control computer monitoring said optical sensor and controlling said stop valve;

turning on said stop valve thereby flowing said fluid from said fluid container, pass said optical sensor, and out said outlet end onto said wafer; and monitoring the flow of fluid past said optical fluid sensor; said optical fluid sensor detecting the presence of gas bubbles in said fluid; and stopping the flow of fluid when the fluid flow past said optical sensor contains gas bubbles.

13. The method of claim 12 which further includes: said fluid comprised of a material selected from the group consisting of Water, etchants, and spin-on-glass.

14. A method of dispensing fluid onto a semiconductor wafer using a dispensing unit which comprises:

a fluid container containing fluid; said fluid container connected to a pressurized gas supply by a gas supply tube and said fluid container connected to a fluid feed tube; said fluid container partially filled with a fluid; said fluid comprised of a material selected from the group consisting of etchants and spin-on-glass;

said fluid feed tube having an inlet end in said fluid in said fluid container and an outlet end above a semiconductor wafer; said fluid feed tube having a transparent section; said optical sensor overlying said transparent section of said feed tube; said outlet end comprises a nozzle for dispensing fluid on a wafer;

a stop valve connected to said fluid feed tube between said fluid container and said outlet end;

a suck back valve connected to said fluid feed tube between said stop valve and said outlet end;

an optical sensor connected to said fluid feed tube between said suck back valve and said outlet end; said optical sensor is position a distance from said outlet end between about 4 and 24 inches; said optical sensor not located in said nozzle;

a control computer monitoring the optical sensor and controlling said stop valve; and the method comprising:

turning on said stop valve thereby flowing said fluid from said fluid container, pass said optical sensor, and out said outlet end onto said wafer;

monitoring the flow of fluid past said optical fluid sensor; said optical fluid sensor detecting the presence of gas bubbles in said fluid; and stopping the flow of fluid when the fluid flow past said optical sensor contains gas bubbles; said control computer stopping the flow of fluid when the fluid flow past said optical sensor contains gas bubbles.

15. The fluid delivery system of claim 14 wherein said suck back valve when activated, pulls said fluid in said fluid feed tube back a distance from said outlet end about between 1 and 5 mm.

16. The fluid delivery system of claim 14 which further includes a fluid level sensor on said fluid container, said fluid level sensor monitoring the level of said fluid in said fluid container, said fluid level indicator connected to an alarm.

* * * * *